US005228268A

United States Patent [19]

Jensen

[11] Patent Number: 5,228,268

[45] Date of Patent: Jul. 20, 1993

[54] FLEXIBLE BAG WITH ARTICLE ENCAPSULATED ON ONE SIDE THEREOF

[75] Inventor: Harold A. Jensen, Brockton, Mass.

[73] Assignee: MHB Industrial Corp., Somerville, Mass.

[21] Appl. No.: 869,533

[22] Filed: Apr. 15, 1992

[51] Int. Cl.[5] ..... B65B 43/06

[52] U.S. Cl. ..... 53/415; 53/135.2; 53/135.3; 53/455; 53/562

[58] Field of Search ..... 53/128.1, 135.2, 135.3, 53/410, 415, 455, 562

[56] References Cited

U.S. PATENT DOCUMENTS

| | | | |
|---|---|---|---|
| 3,807,118 | 4/1974 | Pike | 53/410 |
| 3,998,135 | 12/1976 | Sargent | 53/415 X |
| 4,201,031 | 5/1980 | Wiles | 53/455 |
| 4,290,467 | 9/1981 | Schmidt | 53/455 X |
| 4,662,147 | 5/1987 | Scheja | 53/135.2 |
| 4,726,171 | 2/1988 | Kreager et al. | 53/410 |
| 4,936,817 | 6/1990 | Runge | 53/410 X |
| 4,995,217 | 2/1991 | Francis, Jr. | 53/410 |

FOREIGN PATENT DOCUMENTS

| | | | |
|---|---|---|---|
| 927703 | 6/1973 | United Kingdom | 53/410 |

*Primary Examiner*—John Sipos
*Assistant Examiner*—Daniel Moon
*Attorney, Agent, or Firm*—Samuels, Gauthier & Stevens

[57] ABSTRACT

A system and method for encapsulating three dimensional articles on one side of a bag formed by a bag making machine. A conventional bag making machine is modified configuring the drawrollers to allow for passage of the three-dimensional article. Additionally, a feeding station is used which acquires the article, moves the article to a gluing station where an adhesive is applied to the article. The feeding station then moves the article into a fold formed in the bag. The fold is sealed and the bag subsequently formed.

18 Claims, 5 Drawing Sheets

FLEXIBLE BAG WITH ARTICLE ENCAPSULATED ON ONE SIDE THEREOF

BACKGROUND AND BRIEF SUMMARY OF THE INVENTION

There are two basic machines or systems for forming bags. Fill and form machines are exemplified by U.S. Pat. Nos. 2,260,064; 3,456,866; 4,290,467 and 4,726,171. Bag making machines are exemplified by U.S. Pat. Nos. 3,762,628; 3,998,135; 4,648,860 and earlier issued patents to myself.

The art has distinguished between these two systems because the fill and form machines are for packaging bulky articles for subsequent resale of the packaged product Bag making machines make wickets of bags which when produced may comprise 50 to 200 bags which lay flat. The wickets of bags are subsequently sold for further use, deli bags, etc. Bag making machines are designed to convert flat bag stock into a wicket or bundle of flat bags by drawing the stock in a two-dimensional or planar configuration through a plurality of printing, sealing, cutting, folding and drawing stations. The sealing bars, cutting knives and drawrollers extend across the stock or partially formed bag and define a narrow or linear gap between their acting surfaces; i.e. perimeter of the drawrollers, edge of the knife and between the bag stock upon which the surfaces will act.

Others in the prior art have modified bag forming machines to form pockets or pouches in the bags and have also inserted flat pieces, cards and the like in the pockets formed in the bags. This was possible because the cards or pieces were planar and existing bag making machines could be used without any major modifications or adjustments to carry the flat pieces through the existing equipment.

The present invention is directed to a bag making machine and a method for forming bags wherein three-dimensional articles may be fed to the bag stock while the stock is being formed into a bag. The bag is subsequently formed with the three-dimensional article encapsulated on at least one side thereof. The fill and form machines do not do this and the bag forming machines of the art do not have this capability.

Broadly the invention, in one aspect, comprises a bag making machine which forms a fold on the outer surface of a bag, places a three-dimensional article within the fold in a predetermined orientation and secures the article within the fold while the bag being formed continues to travel through subsequent processing steps to form the bag. Securing the article within the fold prevents disorientation of the article as the bag is subsequently formed.

The invention, in another aspect, embodies a feeding station which inserts the articles into the fold formed on the bag.

The invention, in still another aspect, embodies a drawroller with a tensioning member which allows the article to pass through the drawrollers and which controls the force of the drawrollers acting on the bag stock on either side of the article.

The method of the invention includes feeding a sheet of bag stock having a side terminating in an edge to a sealing station. A strip of film material having at least one edge is also fed through the sealing station. The one edge of the strip is sealed to the edge of the bag stock, the strip extends over the bag stock, terminates in a free edge and defines with the bag stock a fold. A three-dimensional article is inserted into the fold. The article is secured within the fold and the free edge of the fold is sealed to the bag stock to encapsulate the material therein. Subsequently the bag with the encapsulated article is formed.

DESCRIPTION OF THE PREFERRED EMBODIMENT(S)

The preferred embodiment will be described in reference to a bag making machine for making side-weld bags where the bag stock is folded to define a bottom edge and the sides are welded and cut to form the bags. The invention may be used with any bag making machine regardless of the type of bag formed.

In bag making machines, a series of steps in timed sequence are performed on bag stock, such as drawing, welding and cutting steps. The specific structure for the welding and cutting and the control electronics for effecting the various steps are not shown in detail—these features being well within the skill of the art.

Figure 1:
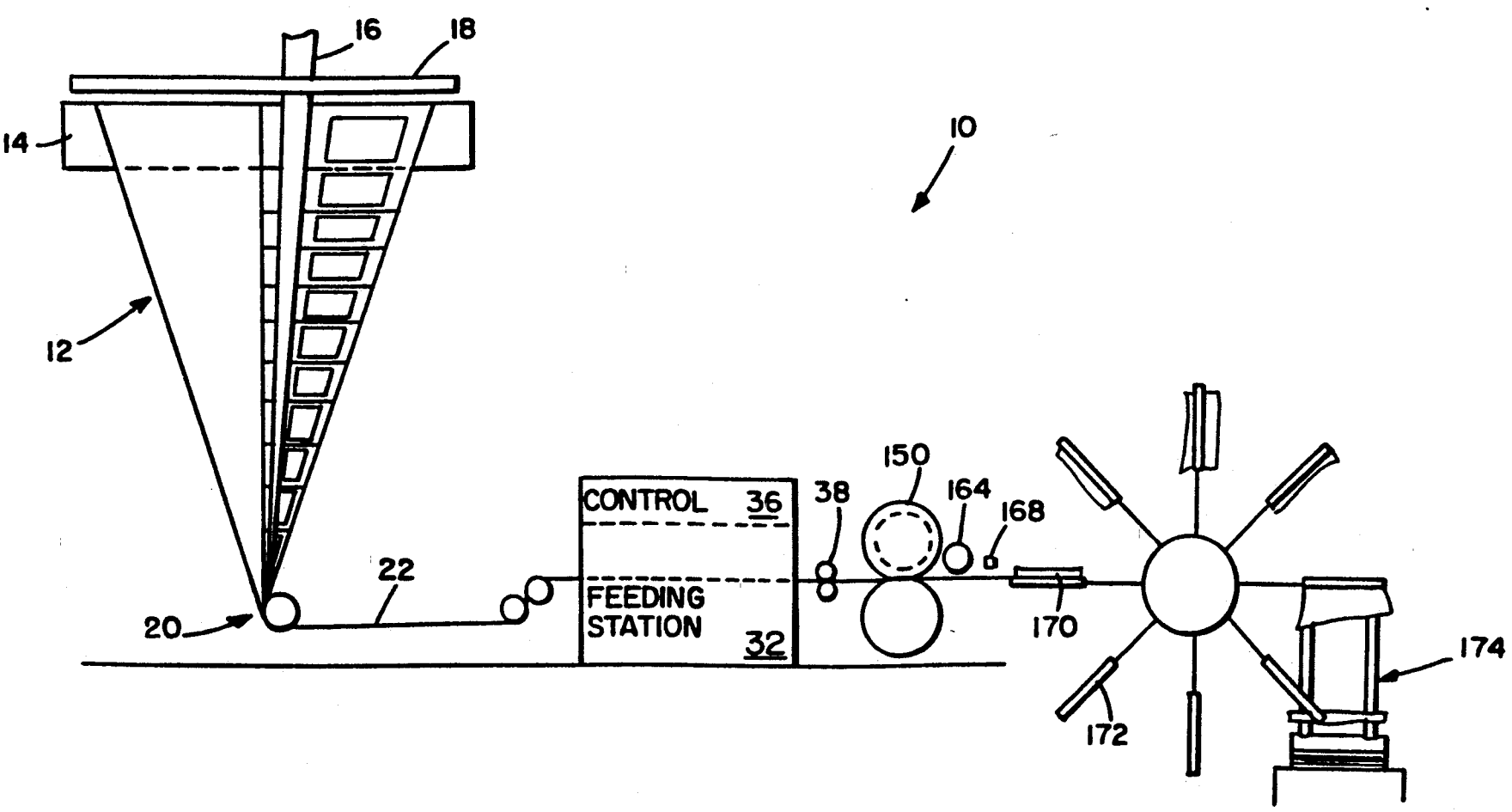
FIG. 1 is an illustration of a modified bag making machine embodying the invention.

Referring to FIG. 1, a bag making machine embodying the invention is shown generally at 10 and comprises bag stock 12 having printing, P, on one surface thereof being drawn over a roller 14. A transparent strip 16 of thermoplastic film such as polyethylene is fed to the bag stock 12 and welded along one longitudinal edge to the bag stock by a sealing bar 18. The bag stock 12 is folded at 20 to form folded bag stock 22 with a bottom edge 24.

A control module 36 is shown symbolically. The control module 36 represents the associated electronics to effect the timed sequence of steps for both forming the bags and inserting the three dimensional article into the fold formed in the bag. The pneumatic cylinders and glue gun described hereinafter are commercially available prior art devices.

The folded bag stock 22 enters a feeding station 34 shown in greater detail in FIGS. 2 to 6. At the feeding station 32 a three-dimensional article 34 is inserted into a fold 28 The folded bag stock 22 with the article 34 inserted into the fold 28 leaves the feeding station 32 and passes under a sealing bar 38 which seals a free end 30 of the fold to the bag to encapsulate the article 34 therebetween.

Figure 7:
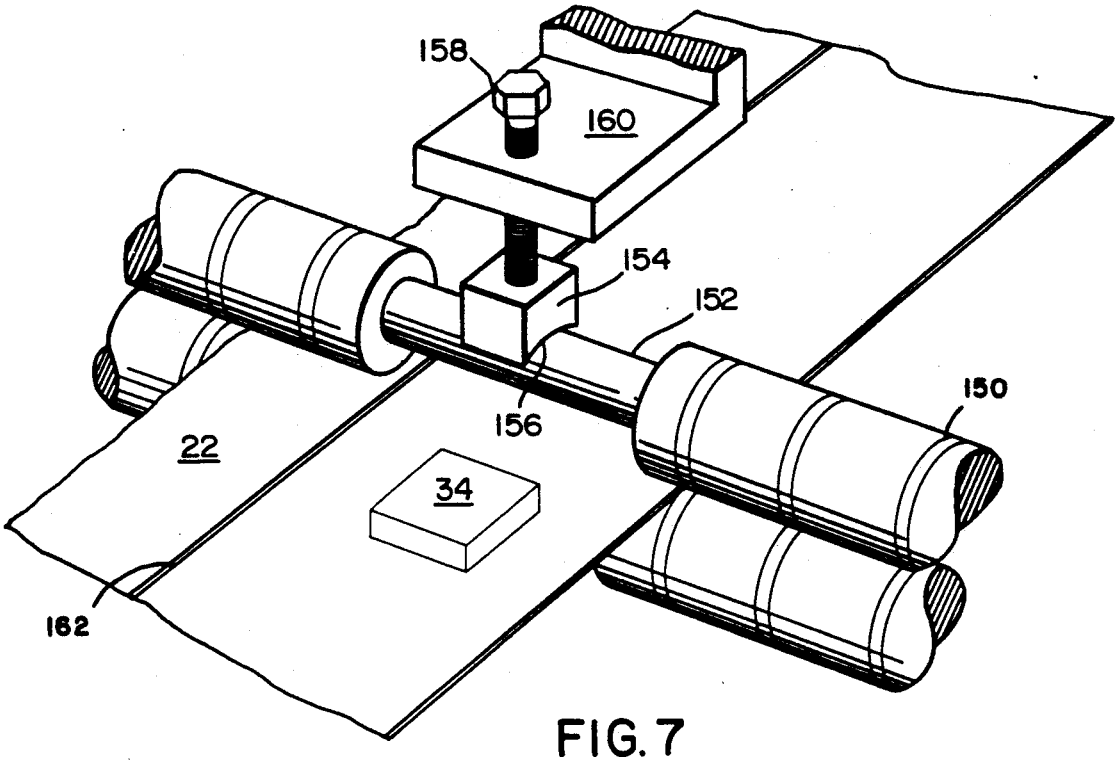
FIG. 7 is a perspective view of a drawer roll tensioning member.
Figure 8:
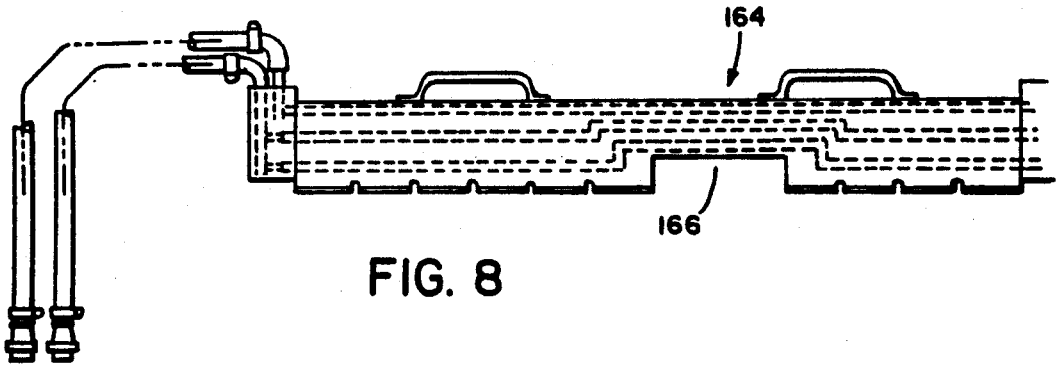
FIG. 8 is a front view of a water jacket.

The folded bag stock with the encapsulated article is then drawn by drawrollers 150, shown in greater detail in FIG. 7 and passes under a water jacket 164 shown in greater detail in FIG. 8. The drawrollers and water jacket are modified in accordance with the invention.

The folded bag stock then passes under a cutting and sealing bar 168 where side welds are formed and a bag 170 is formed and severed from the bag stock. The just-formed bag 170 is carried by a vacuum platen 172 and deposited on wickets 174.

Figure 2:
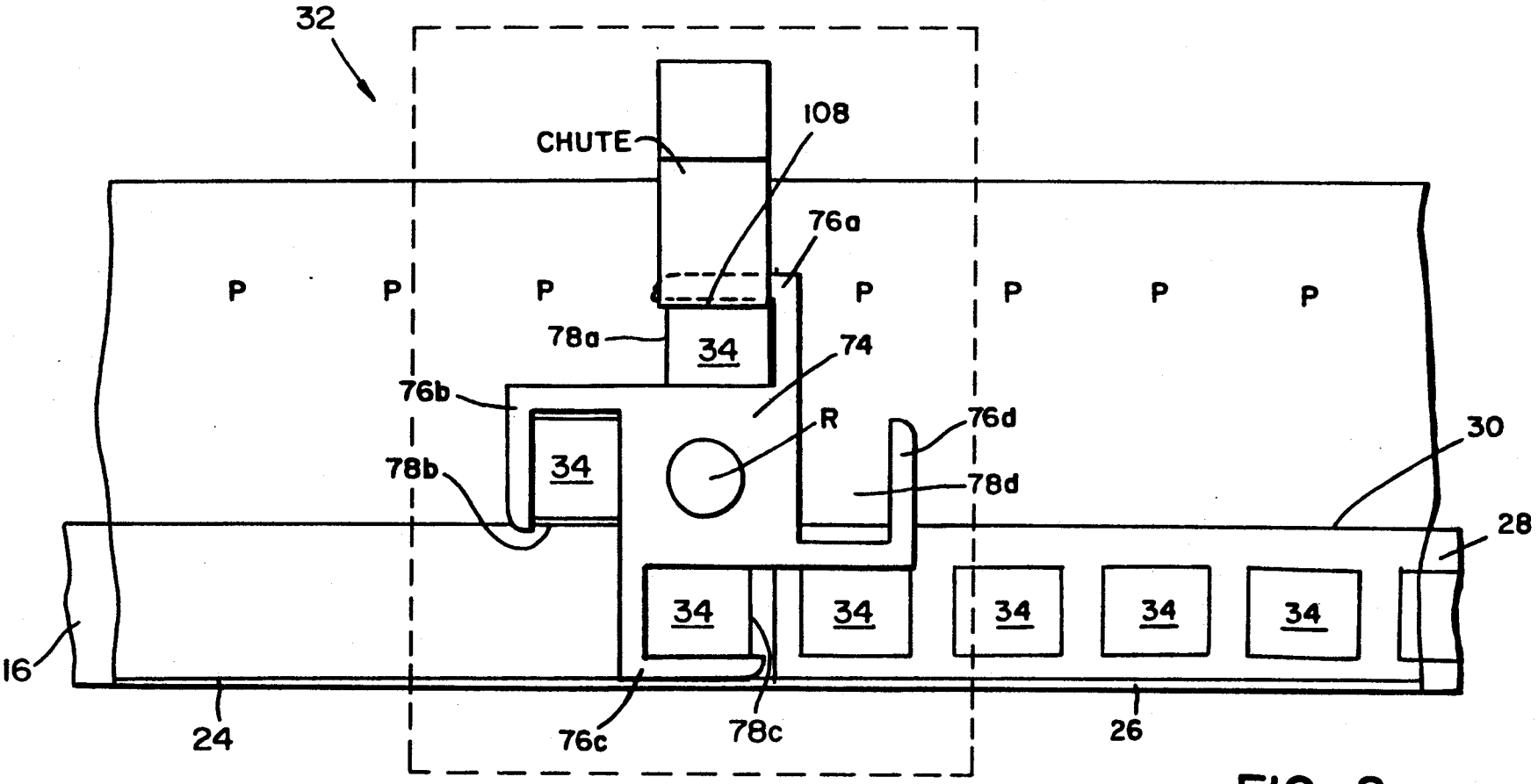
FIG. 2 is a plan view of a feeding station.

Referring to FIG. 2, the strip 16 welded at 26 to the bottom edge 24 extends upwardly away from the bottom edge to define the fold 28 having the free end 30.

Figure 3:
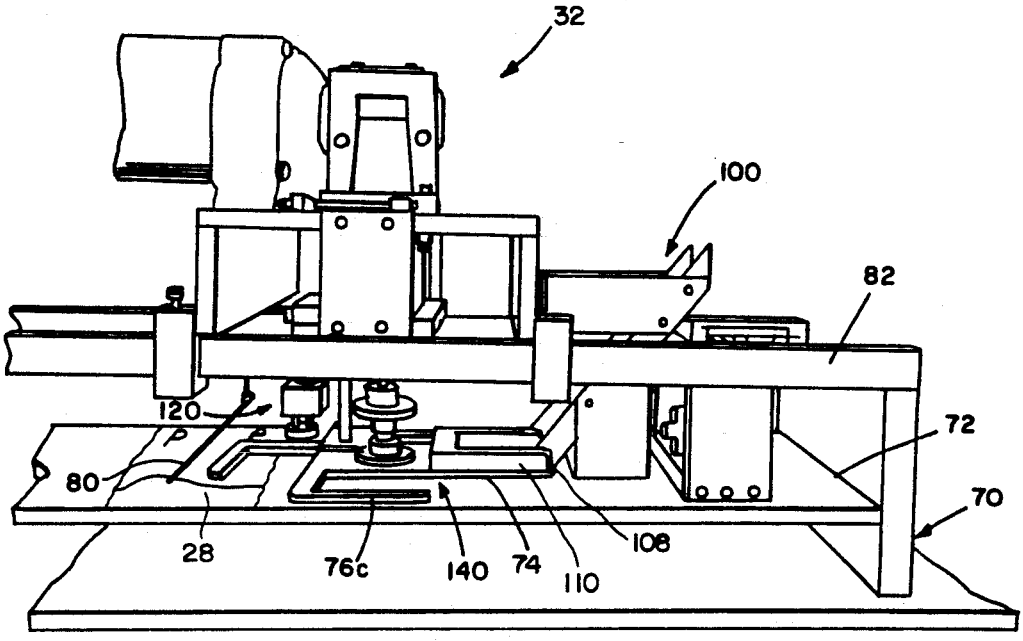
FIG. 3 is an end view of the feeding station of FIG. 2.

Referring to FIGS. 2 and 3, the feeding station 34 comprises three substations. An acquisition station 100 (FIG. 4), a gluing station 120 (FIG. 5) and an insertion station 140 (FIG. 6).

The feeding station 32 comprises a support structure shown generally at 70 including a base plate 72 on which the bag stock travels. Secured to the base plate 72 and spaced apart therefrom is an four-armed member 74. The member 74 is pinned to a shaft (not shown) which passes through the base plate 72 and is rotated about its axis, R, in 90° increments by a motor (not shown) joined to the shaft. The member 74 is spaced apart from the base plate 72 such that the bag stock 22 may pass under it. The member 74 is sufficiently close to the bag stock such that the three-dimensional article 34 may be inserted into the fold 28 formed in the bag stock 22. Also secured in part to the base plate 72 is the acquisition station 100. A superstructure 82 supports in part the acquisition station 100, supports a pneumatic stop blade and a pneumatic glue gun at the gluing station 120 and supports a pneumatic piston and a pneumatic stop blade at the insertion station 140.

Referring to FIG. 2, the armed member 74 comprises arms 76*a*, 76*b*, 76*c* and 76*d* which define slots 78*a*, 78*b*, 78*c* and 78*d* which generally correspond to the dimensions of the article to be inserted into the fold. The arms rotate, in 90° increments, through the acquisition station 100 where the article is fed to the arm, through the gluing station 120 where glue is applied to the upper surface of the article and through the insertion station 140 where the article is inserted into the fold 28 in the bag stock 22 and the fold is depressed to engage the glued surface of the article.

As shown in FIG. 3, a rod 80 extends across the upper surface of the base plate 72 and engages the fold 28 to maintain the fold 28 in spaced apart relationship from the bag stock 22 in order that the arms may move into position and insert the article 34 into the fold 28.

Figure 4:
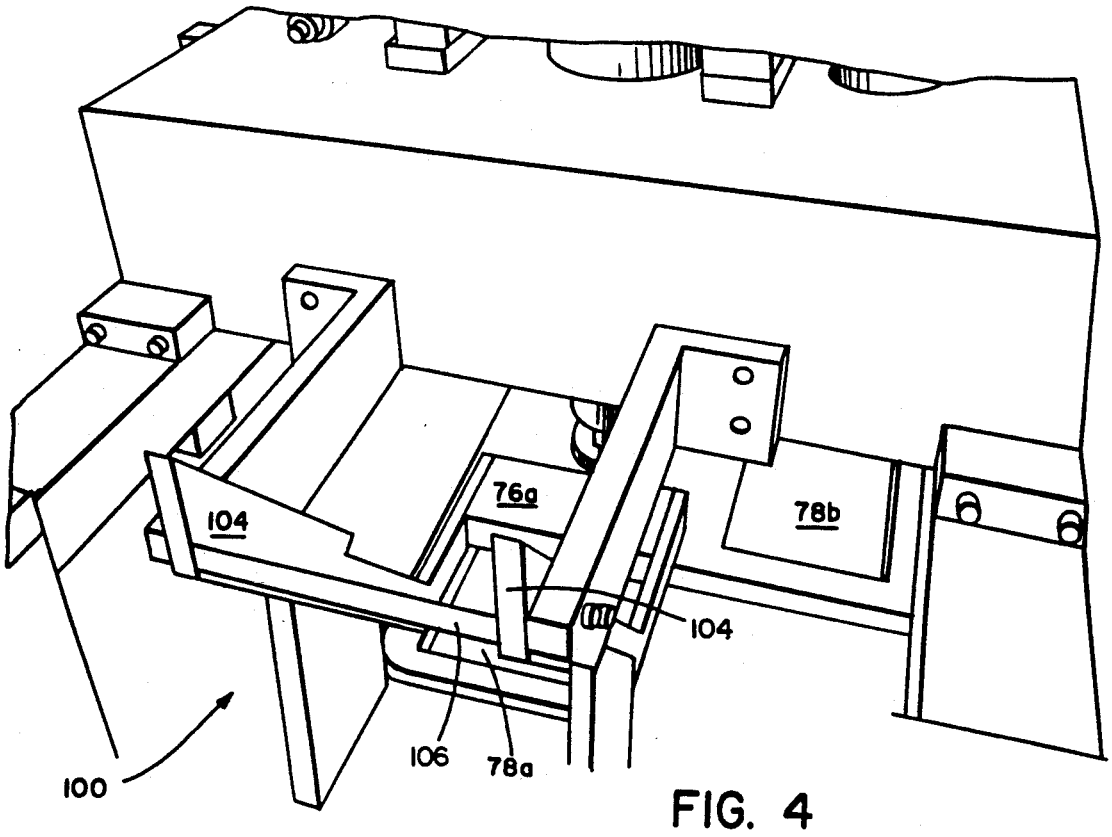
FIG. 4 is a perspective view of an acquisition station.

Referring to FIG. 4, the acquisition station 100 comprises a chute 102 having spaced parallel walls 104. The chute comprises an upstream end 106 and a downstream end 108 (FIG. 2). Articles to be inserted into the fold are automatically fed to the upstream end. The articles travel down the chute and are received in the slot 78*a* in the arm 76*a*. A U-shaped retaining wall (FIG. 3) is secured to the end 108 to secure and hold the article 34 until the article 34 is acquired by the arm 76*a*. The wall 110 is spaced apart from the base plate 72 a sufficient distance to allow for passage of the arms 76*a*, 76*b*, 76*c* and 76*d*.

Figure 5:
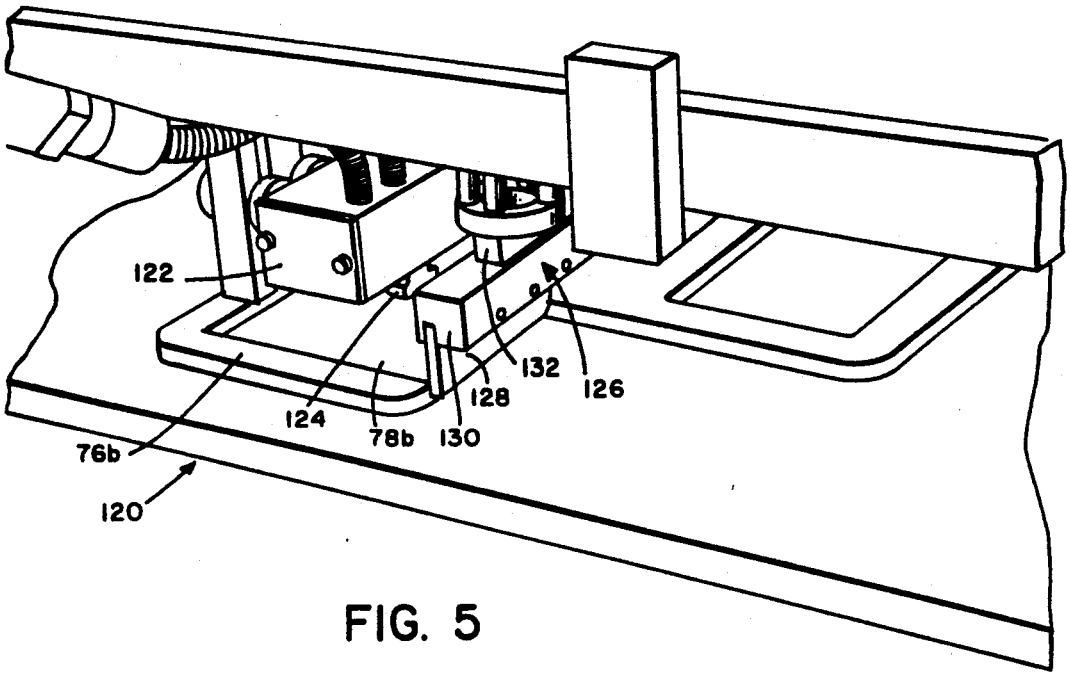
FIG. 5 is a perspective view of a gluing station.
Figure 6:
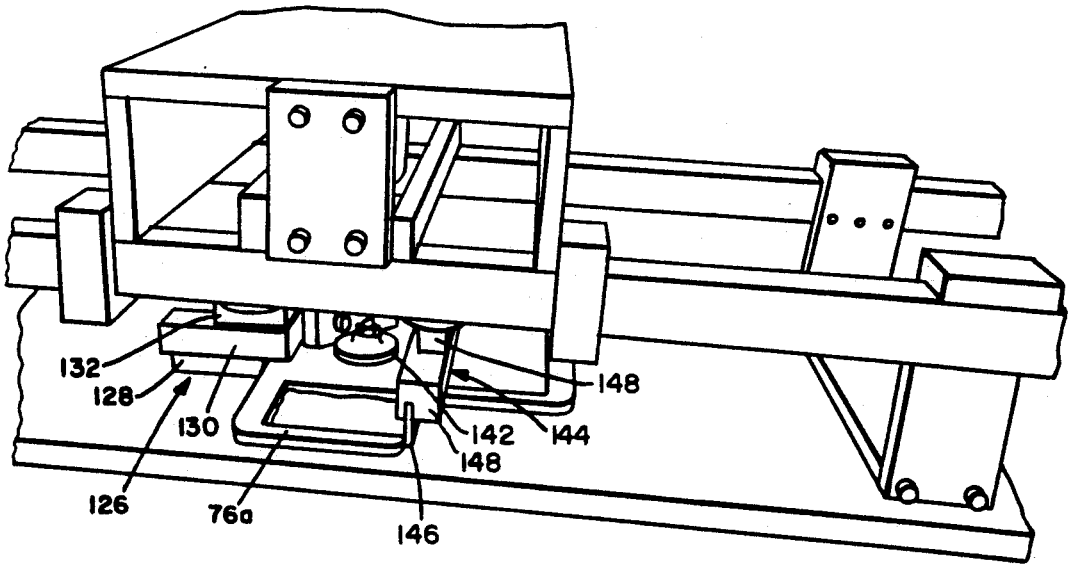
FIG. 6 is a perspective view of the insertion station.

Referring to FIG. 5, the gluing station 120 comprises the glue gun 122, such as a Slautterback Hot Melt Applicator, with a dispensing tip 124 which is pneumatically actuated. Also, a pneumatically actuated stop blade 126 (not shown in FIG. 3) is positioned to close the open end of the arm 76*b* carrying the article 34. The dispensing tip 124 extends to apply a metered amount of glue to the top of the article 34 and then retracts. The arm 126 comprises a flexible blade member 128 secured in a base 130 which base 130 is joined to a pneumatic plunger 132. Prior to the completion of the rotation of the armed member 74 the stop blade 126 moves downwardly whereby the blade member 128 is in register with the open side of the slot 78*a*. The armed member 74 rotates 90°. The arm 76*a* carrying an article 34 with it moves from the acquisition station 100 to the gluing station 120. The armed member 74 stops and the glue is applied to the top surface of the article 34. The stop blade 126 then retracts and the armed member rotates 90°.

Referring to FIG. 6, the insertion station 140 is shown and comprises a pneumatically actuated plunger 142 and a pneumatically actuated stop blade 144. The stop blade 144 comprises a blade member 146 secured in a base 148 which base is secured to a pneumatic plunger 149. As with the stop blade 126 at the gluing station, prior to the completion of the rotation of the armed member 74, the stop blade 144 will move downwardly whereby the blade member 146 will be in register with the open side of the slot 78*a*. The armed member 74 rotates 90° and the arm 76*a* moves to the insertion station with the member 34 on the bag stock 22 and under the fold 28. The stop member 144 prevents the article from leaving or moving from the slot 78*a*. The plunger 142 extends causing the underside of the fold 28 to engage the glue on the article 34. The stop blades 126 and 144 then retract. The bag stock moves one bag length. Then the armed member 74 rotates 90° and the sequence continues. Adherence of the article 34 to the fold 28 holds the position or orientation of the article during subsequent processing steps.

Referring to FIG. 7, a drawroller 150 is shown in greater detail. The drawroller comprises a reduced portion 152 which is engaged to a tensioning block 154 having a concave surface 156 which mates with the outer surface of the reduced portion. A tensioning screw 158 engages the tensioning block 154 and is threaded through a plate 160. The transport of the bag stock 22 with the encapsulated article 34 is also shown with the longitudinal seal line 162.

Immediately downstream of the drawroller is the water jacket 164, which is shown in FIG. 8, is modified to include a recess 166 from the prior art water jackets to allow for passage of the article.

Figure 9:
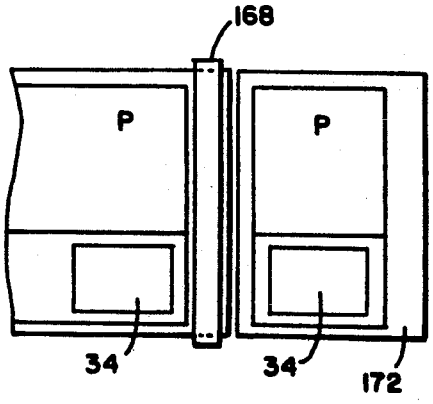
FIG. 9 is a plan view of a bag being transferred to the wicket.

Referring to FIG. 9, the leading edge of the bag stock 22 is shown immediately downstream of the sealing bar 168 which forms the side welds and forms the bag 170 which is carried by the platen 172. The transverse side weld is shown as 176.

In the operation of the invention, the bag stock 12 passes over roller 14 and the transparent strip of film material 16 is sealed along one longitudinal edge. The bag stock is folded at 20 to form a bottom edge with the strip sealed along its edge to the bottom of the now-folded bag stock and the fold extending upwardly from the bottom edge.

When the bag stock approaches the feeding section, the rod 80 is originally threaded between the bag stock 22 and the flap 28 to hold the flap 28 in its spaced apart condition. Initially, the article 34 is fed down the chute and is received in the slot 78*a* of the arm 76*a*. The stop blades 126 and 144 are in their retracted positions. The member 74 rotates 90°. The article 34 carried by the arm 76*a* moves to the gluing station. After the arm has rotated approximately 85°, the stop blade 126 extends preventing the article 34 from being dislodged from the slot 78*a*.

At the acquisition station, the arm 76*b* acquires an article which is received in its associated slot 78*b*. At the gluing station, the glue gun deposits a drop of glue on the upper surface of the article 34. The stop blades 126 and 144 are retracted and after the armed member 74 has rotated approximately 85° the stop blades are then moved downwardly to prevent dislodgment of the articles 34.

The arm 76*a* with its associated article 34 is now at the insertion station. The piston 142 is actuated to tamp down the fold 28 onto the article to effect adhesion between the fold and the article. The arm 76*b* is at the gluing station while the arm 76*c* is at the acquisition station where its associated slot 78*c* receives an article.

The sequence of steps, namely the acquisition of an article by the armed member 74, the application of the glue at the gluing station and the tamping down of the flap onto the glue spot at the insertion station all occur substantially simultaneously. Prior to the movement of the armed member 74, the stop blades 126 and 144 retract. The bag stock moves one bag length. Then the armed member 74 rotates. When the armed member has completed approximately 85° of its 90° rotation, the stop blades are extended downwardly such that they are in place when the armed member completes its rotation and stops.

The upper edge of the flap 28 is sealed by the sealing bar 38. After acquisition, gluing and insertion, the drawrollers 150 rotate, drawing the bag stock through the drawrollers and throwing the bag stock drawn through the drawrollers, through the water jacket 164 into position under the sealing bar 168 and placing the leading portion of the bag stock on the platen 172. That is, at this point, the leading portion of the bag stock from which the bag will finally be formed overlays the vacuum plate. The sealing bar 168 forms sidewells in the bag being formed on the vacuum plate and the leading edge of the bag stock. The plate is rotated to place the formed bag on the wicket 174.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method for forming a flexible bag with a three-dimensional article encapsulated on one surface thereof which includes:

welding a strip of film material having one and other edges only along the one edge thereof to a sheet of bag stock, the remainder of the strip being non-welded;

folding the bag stock along a fold line such that the strip extends over the bag stock and terminates in the other free edge and defines with the bag stock a fold;

maintaining the non-welded portion of the strip in spaced apart relationship from the bag stock;

inserting a three-dimensional article into the fold formed by the strip;

securing adhesively the article within the fold to prevent disorientation of the article in the fold during subsequent bag forming steps;

securing subsequently the free edge of the strip to the bag stock to form a compartment and to encapsulate the article therein; and forming a bag from the bag stock with the encapsulated article.

2. The method of claim 1 wherein the bag is a side-weld bag.

3. The method of claim 1 wherein the bag stock is folded along the fold line to define a bottom edge adjacent a weld line where the strip is secured to the bag stock such that the strip extends upwardly from the defined bottom edge over the bag stock.

4. The method of claim 1 which includes:

applying adhesive to at least one surface of the article.

5. The method of claim 4 which includes:

maintaining the article in a fixed orientation while the adhesive is being applied.

6. The method of claim 1 which includes:

maintaining the fixed orientation of the bag stock while the article is inserted into the fold.

7. The method of claim 6 which includes:

adhesively engaging the opposed surface of the fold to the article.

8. The method of claim 7 which includes:

sealing the free edge of the strip.

9. The method of claim 7 which includes:

inserting a first article into the fold while applying adhesive to a second article.

10. The method of claim 6 which includes:

receiving a first article at an acquisition station;

applying adhesive to a second article at a gluing station; and inserting a third article into the fold at a feeding station.

11. A system to form a flexible bag with a three-dimensional article encapsulated on one surface thereof which comprises:

means to weld an edge of a strip of film material to a sheet of bag stock;

means to fold the bag stock along a fold line such that the strip extends over the bag stock and terminates in a free edge and defines with the bag stock a fold;

means to insert a three-dimensional article into the fold;

means to adhesively secure the article within the fold to prevent disorientation of the article during subsequent bag forming steps;

means to secure the free edge of the strip to the bag stock to form a compartment and to encapsulate the article therein; and means to form a bag from the bag stock with the encapsulated article on at least one side of the bag.

12. The system of claim 11 wherein the bag is a side weld bag.

13. The system of claim 11 which includes:

means to fold the bag stock to define a bottom edge adjacent a weld line such that the strip is secured to the bag stock and extends upwardly from the defined bottom edge over the bag stock.

14. The system of claim 11 wherein the means to secure the article within the fold includes means to apply adhesive to at least one surface of the article.

15. The system of claim 11 which comprises:

a feeding station, which feeding station comprises three substations comprising an acquisition station which includes means to feed an article to an arm; a gluing station which includes means to apply glue to the article; and an insertion station which includes means to insert the article into the fold formed in the bag stock.

16. The system of claim 15 which includes:

means to effect movement of the arm in timed sequence.

17. The system of claim 15 which includes:

means to maintain the fold spaced apart from the bag stock when the article is inserted into the fold at the insertion station.

18. The system of claim 15 which includes:

means to prevent the article form dislodging from the arm in which it is carried when the arm rotates between stations.

* * * * *